US006031195A

United States Patent [19]

Meili et al.

[11] Patent Number: 6,031,195

[45] Date of Patent: Feb. 29, 2000

[54] LATCHING MECHANISM FOR AN ELECTRICAL OVERLOAD PROTECTION SWITCH, IN PARTICULAR FOR A MOTOR-PROTECTION CIRCUIT BREAKER

[75] Inventors: Hans-Peter Meili, Seon; Karin Hannelore Spengler-Schmid; Stephan Spengler, both of Siblingen, all of Switzerland

[73] Assignee: Allen-Bradley Company, LLC, Milwaukee, Wis.

[21] Appl. No.: 09/059,076

[22] Filed: Apr. 10, 1998

[30] Foreign Application Priority Data

Jul. 14, 1997 [CH] Switzerland ..... 1713/97

[51] Int. Cl.[7] ..... H01H 1/52

[52] U.S. Cl. ..... 200/318; 200/320; 200/321

[58] Field of Search ..... 200/329–332.2, 200/318–327, 5 V, 5 E, 5 EA, 5 EB

[56] References Cited

U.S. PATENT DOCUMENTS

| | | | |
|---|---|---|---|
| 5,512,720 | 4/1996 | Coudert et al. | 200/400 |
| 5,576,677 | 11/1996 | Malingowski et al. | 335/172 |
| 5,757,602 | 5/1998 | Meili et al. | 361/115 |

FOREIGN PATENT DOCUMENTS

| | | |
|---|---|---|
| 0 367 102 | 10/1989 | European Pat. Off. . |
| 31 19 165 | 5/1981 | Germany . |
| 39 07 094 | 3/1989 | Germany . |
| 93 02 252 | 2/1993 | Germany . |

*Primary Examiner*—Michael L. Gellner
*Assistant Examiner*—Nhung Nguyen
*Attorney, Agent, or Firm*—David G. Luettgen; John J. Horn; John M. Miller

[57] ABSTRACT

A latching mechanism comprises a stationary chamber (1), a spring-loaded main slide (2) which is guided along the stationary chamber (1) in a first direction, a spring-loaded message slide (3) disposed inside the stationary chamber (1) which is guided in a second direction perpendicular to the first direction, and a spring-loaded snap lever (4) which is pivotally mounted inside the stationary chamber (11) and which supports the switch lock's toggle linkage during the switched-on position of an overload protection switch. The main slide (2) is mechanically coupled to a manual actuator. During switching-on, the main slide (2) is moved in the direction of the message slide (3), such that the message slide (3) is moved via interacting bevels (19, 28), and locks the main slide (2). During tripping, the trip latch moves the message slide (3), causing the main slide (2) to be locked into a tripped position and causing the snap lever (4) to be released. Advantageously, in order to switch off and reset after tripping, an increased force must be applied manually. The reset or main spring (12) is housed inside the main slide (2) and does not affect the switch lock. Additionally, it is possible to adjust the resetting strength of the main spring (12), which acts upon the manual actuator.

20 Claims, 8 Drawing Sheets

LATCHING MECHANISM FOR AN ELECTRICAL OVERLOAD PROTECTION SWITCH, IN PARTICULAR FOR A MOTOR-PROTECTION CIRCUIT BREAKER

BACKGROUND OF THE INVENTION

1. Field of the Invention

The present invention relates to a latching mechanism for electrical overload-protection switches, and in particular to a latching mechanism for a motor protection circuit breaker. More particularly, the present invention relates to a latching mechanism for a motor protection circuit breaker in which the latching mechanism latches a manual actuator in a tripped position and includes a mechanism that transmits a tripped-message to an auxiliary switch.

2. Description of Related Art

EP-B1-0612089 describes a switching device for circuit breakers. The most important actuating elements of the switching device consist of a manual actuator that is actively connected to a switch lock and a toggle lever that can be tensioned by the manual actuator. The toggle lever can be tripped either by the manual actuator itself or through thermal or magnetic tripping devices by buckling. On the switching device, a mechanism is provided that transmits a tripped-message to an auxiliary switch. A resetting spring provided for the manual actuator also acts upon the toggle lever and thus affects the release forces of the switching device. Because the resetting spring acts upon the toggle lever, the increased resetting force that is required for a gate coupling drive cannot be achieved with out special measures. In addition, the assembly of the switching device is difficult because of its many joints, especially if the switching device is to be assembled in a fully automatic fashion.

SUMMARY OF THE INVENTION

A primary object of the invention is to provide an economically advantageous latching mechanism of the type previously mentioned, which is composed of few parts, which can be easily assembled, and on which the resetting force which acts upon the manual actuator can be adjusted as required by the application.

In accordance with one aspect of the present invention, the present invention provides a latching mechanism for an overload protection switch which includes a stationary chamber, a main slide, a message slide, and a snap lever. The stationary chamber includes a first guide which is oriented in a first direction, and a second guide which is oriented in a second direction. The first and second directions are perpendicular to each other. The main slide is coupled to a manual actuator and is movable along the first guide. The main slide includes a main spring which spring-loads the main slide. The message slide is movable along the second guide and includes a message slide spring which spring-loads the message slide.

A particularly preferred embodiment of the latching mechanism also exhibits the following features. Specifically, the main slide includes a first switch-off bevel, a first switch-on bevel, a striking bevel, and a snap lever support. Similarly, the message slide also includes a second switch-off bevel, a second switch-on bevel, and a striking counter bevel. Additionally, the latching mechanism also includes a snap lever which is pivotally mounted to the stationary chamber and which includes a snap lever spring which spring loads the snap lever. The latching mechanism has a switched-off position, a switched-on position, and a tripped position, and the main slide, message slide, and the snap lever each have a switched-off position, a switched-on position, and a tripped position which respectively correspond to the switched-off position, the switched-on position, and the tripped position of the latching mechanism.

During a switching-on motion from the switched-off position to the switched-on position of the latching mechanism, the main slide moves the message slide to the switched-on position by way of the first and second switch-on bevels. In the switched-on position of the latching mechanism, the main slide and message slide are locked in the switched-on position by the first and second switch-off bevels. Additionally, the snap lever support supports the snap lever in the switched-on position, and the snap lever in turn supports the overload protection switch in a switched-on position of the overload protection switch.

During a tripping motion from the switched-on position to the tripped position of the latching mechanism, a tripping motion impulse is applied to the message slide and moves the message slide along the second guide to the tripped position. The movement of the message slide unlocks the message slide and the main slide from the switched-on position. The unlocking of the main slide causes the main slide spring to move the main slide along the first guide to the tripped position. Finally, the movement of the main slide causes the snap lever support to release the snap lever. In the tripped position of the latching mechanism, the striking counter bevel retains the main slide in the tripped position.

During a resetting motion from the tripped position to the switched-off position, the striking counter bevel cooperates with the striking bevel to move the message slide to the switched-off position.

Advantageously, the latching mechanism can have relatively few parts, and also can be easily assembled in a fully automatic fashion. Because the main slide is locked at the message slide in the switched-on position of the overload protection switch, the main spring acts only upon the main slide and it does not affect the toggle lever and thereby does not affect the release forces of the overload protection switch.

According to a preferred embodiment, the main slide is box-shaped, and the main spring is housed in the box-shaped cavity. As a result, the main spring supports itself with one end on the wall of the box-shaped cavity, and with the other end on a fixed inset which protrudes into the box-shaped cavity. This arrangement not only permits space-saving placement of the main spring, but also enables the main spring to act only upon the main slide.

According to another preferred embodiment, the main slide has a gear rack. The gear rack facilitates a simple, positive connection between the manual actuator, which has a corresponding gear wheel, and the main slide.

According to another preferred embodiment, the message slide is equipped with a release lug that protrudes from the stationary chamber to grip the trip latch. This simple arrangement is especially suitable for fully automatic assembly.

According to another preferred embodiment, the message slide is equipped with a message lug that protrudes from the stationary chamber. The message lug transmits a tripped-message to an auxiliary switch, thereby facilitating a simple coupling of the tripped-message to the auxiliary switch elements.

According to another preferred embodiment, the message slide is equipped with a snap lock formed of two springy jaws which, in the latched position of the latching mechanism, rest detachably at a retaining lug formed at the stationary chamber. This simple arrangement facilitates a secure locking of the latching mechanism in the tripped-position.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENTS

Figure 1:
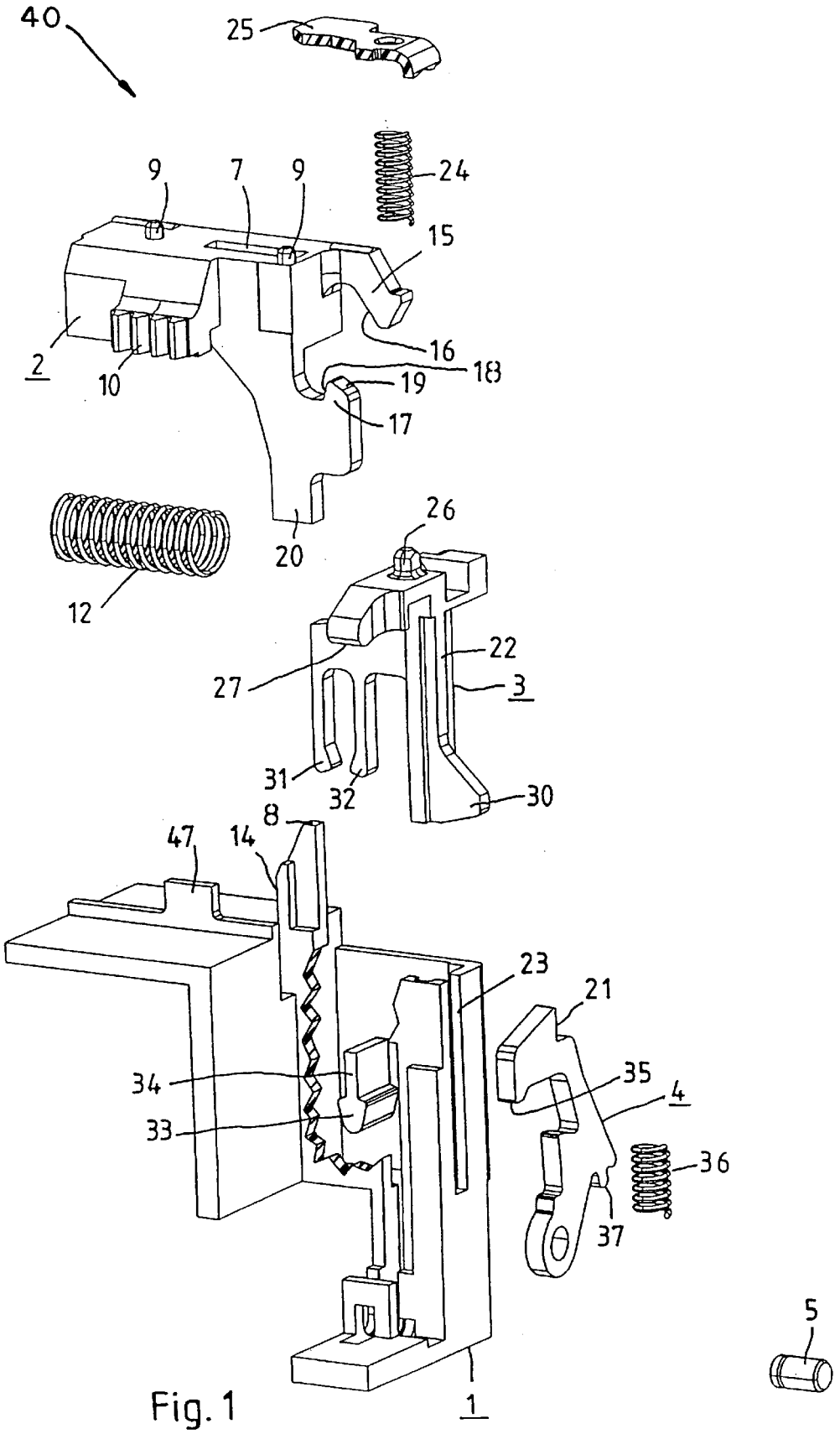
FIG. 1 is an exploded perspective view of a latching mechanism according to an embodiment of the present invention.
Figure 2:
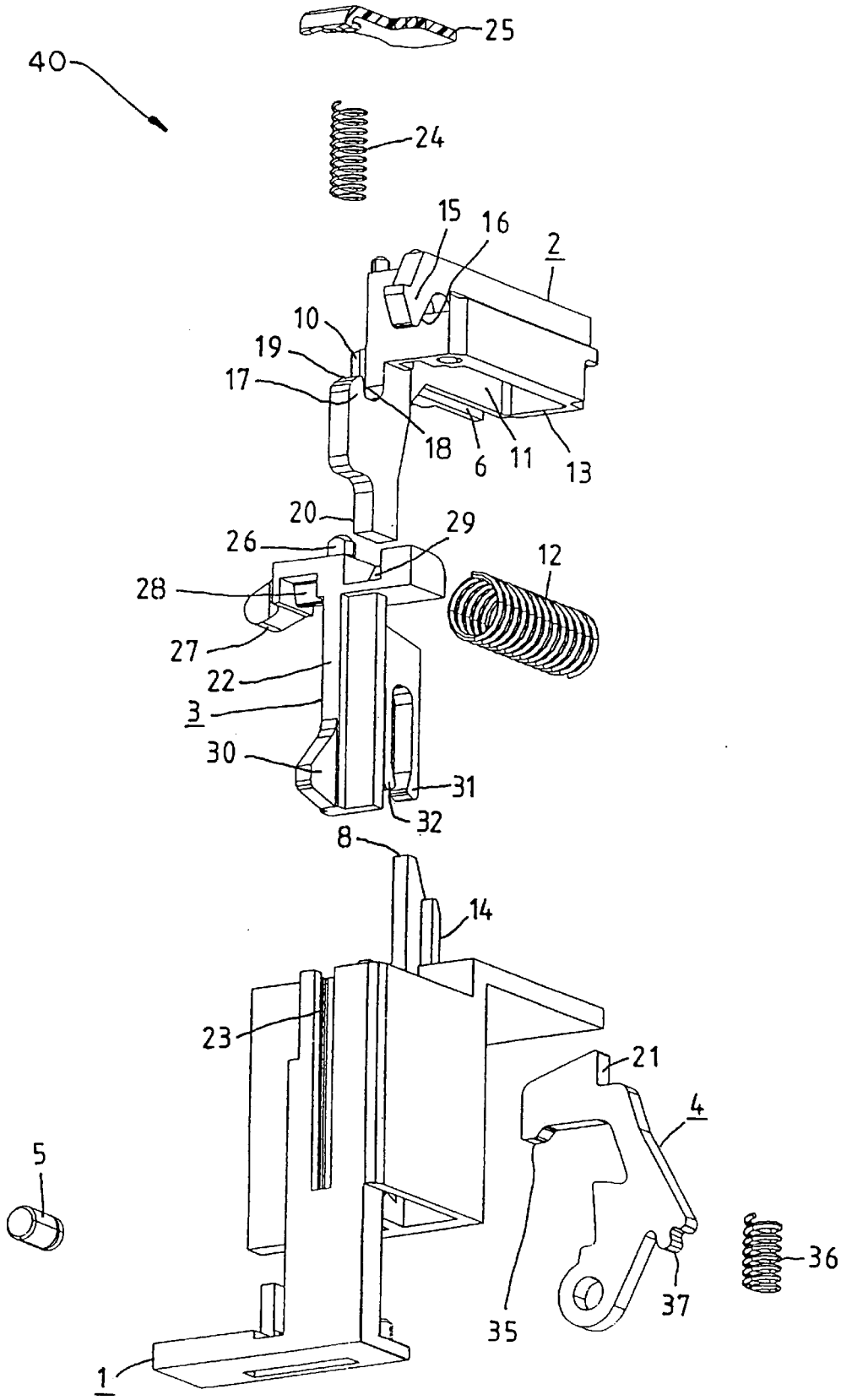
FIG. 2 is an exploded perspective view of the latching mechanism of FIG. 1, viewed from a different angle.
Figure 15:
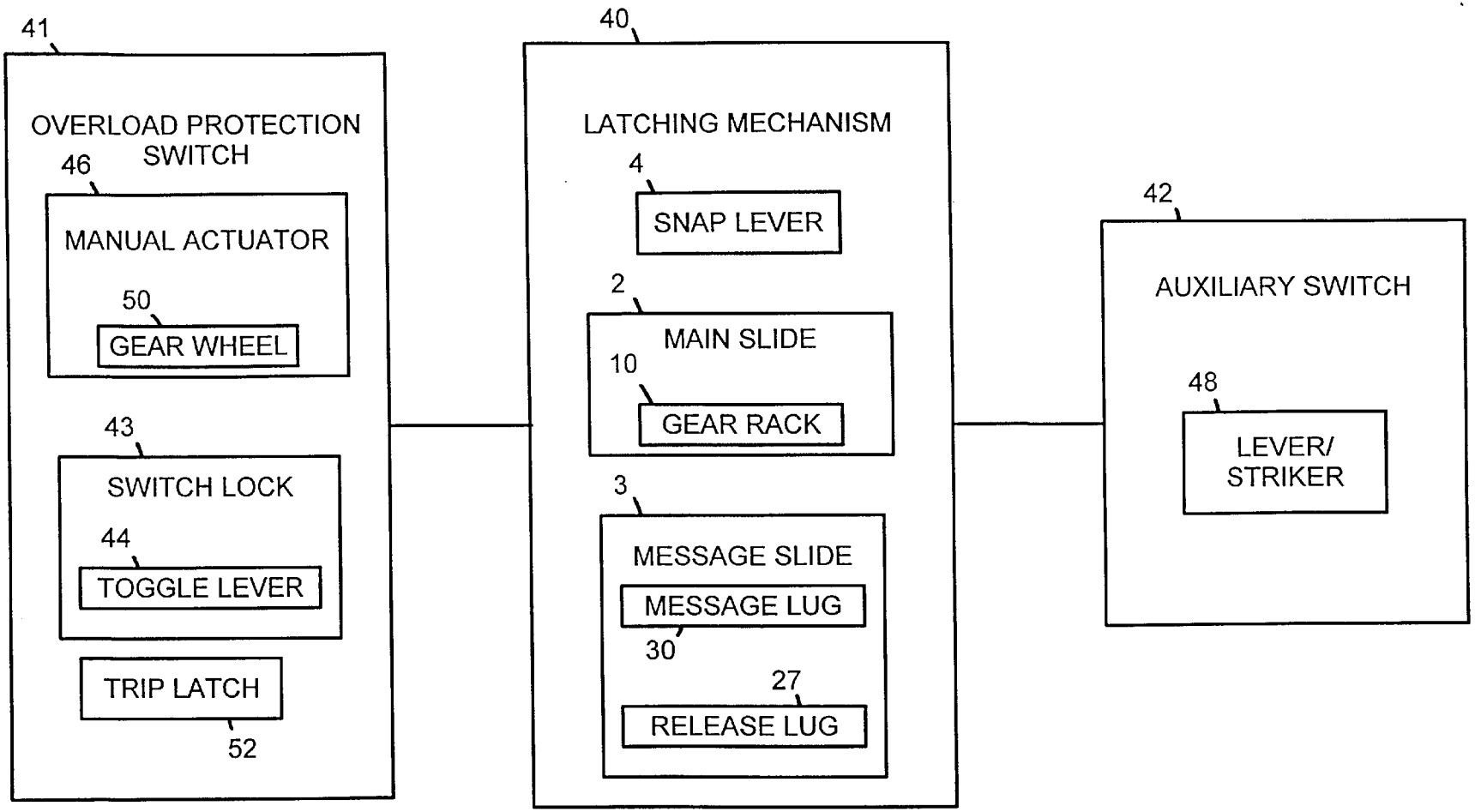
FIG. 15 is a schematic view of the interconnection of the latching mechanism of FIG. 1 with an overload protection switch and an auxiliary switch.

Referring now to FIGS. 1, 2 and 15, exploded views from different angles of the components of a latching mechanism 40 are illustrated in FIGS. 1 and 2, and a schematic view of the interconnection of the latching mechanism 40 with an overload protection switch 41 and an auxiliary switch 42 is illustrated in FIG. 15. The latching mechanism 40 is usable in conjunction with the electrical overload protection switch, and which may for example be a motor-protection circuit breaker. The overload protection switch 41 may for example be of the type disclosed in U.S. Pat. No. 5,757,602, which is the U.S. counterpart of Swiss Patent Application No. 00307/96 dated Feb. 6, 1996 by the same inventor. The overload protection switch 41 has a switch lock 43 with a toggle lever 44. The switch lock 43 can be tensioned by a manual actuator 46. The overload protection switch 41 is equipped with a release lug that can be tripped by an excess current and also acts upon the switch lock 43 via the latching mechanism 40. The latching mechanism 40 latches the manual actuator 46 in the tripped position and includes a mechanism which transmits a tripped message to the auxiliary switch 42, which typically comprises a lever or a striker 48.

A stationary chamber 1 is provided with guide elements that are perpendicularly arranged with respect to each other. On the top of the stationary chamber 1 is a guide for a main slide 2, and vertical thereto is a guide for a message slide 3. In the lower section of the stationary chamber 1, a snap-lever 4 is pivotally mounted by way of an inserted bolt 5.

The main slide 2 has a groove 6 into which a ridge 47 that is formed on the top surface of the stationary chamber 1 fits as a guide. A groove 7, which is recessed on top of the main slide 2, accepts a tip 8 formed on the stationary chamber 1 to guide the main slide 2. On the upper surface of the main slide 2, two cams 9 are provided, which engage into guide grooves in a part of the housing that is not illustrated. Disposed on the side of the main slide 2 is a gear rack 10 that is mechanically coupled to a gear wheel 50 of the manual actuator 46. The main slide 2 is formed in the shape of a box and has a box-shaped cavity 11. A helical main spring 12 is disposed inside the cavity 11. The main spring 12 supports itself in the assembled state with one end on an inside wall 13 of the main slide 2, and with the other end on a fixed inset 14 that is formed on the stationary chamber 1, which protrudes into the cavity 11 of the main slide 2. The main slide 2 has a sloped extension 15 on its end section, which is facing the message slide 3. As described below, the angular position of a bevel 16 of the sloped extension 15 determines the position of the manual actuator in the tripped position. A control lug 17 on the main slide 2 determines the switch-off moment of the overload switch with a switch-off bevel 18, and determines the switch-on moment with a switch-on bevel 19, as explained in detail below. The main slide 2 furthermore has a surface supported snap lever support 20 that supports a support surface 21 of the snap lever 4 in the switched-on position of the overload protection switch 41.

The message slide 3 is guided in a groove 23 of the stationary chamber 1 by a rib 22. The message slide 3 is pushed into the stationary chamber 1 by a message slide spring 24. The message slide spring 24 supports itself on top by a portion of housing 25 (of which only a small section is illustrated), and on the bottom by a peg 26 formed on the message slide 3. The message slide 3 has a release lug 27 that has been provided for gripping the trip latch, which protrudes from the stationary chamber 1 in its assembled state. A switching-off beveled surface 28, which interacts with the switching-off bevel 18 on the main slide 2, is formed onto the message slide 3. On the back surface of the switching-off beveled surface 28 is another bevel 43 (FIGS. 4 and 11) that interacts with the switching-on bevel 19. Furthermore, another counter bevel 29, which interacts with a striking bevel 16 formed on a bearing surface 16 on the main slide 2, is disposed on the message slide 3. The message slide 3 is provided with a message lug 30, which protrudes from the stationary chamber 1 when assembled. The message slide 3 is equipped with a snap lock composed of two springy jaws 31 and 32. In the latched position of the latching mechanism the jaws 31 and 32 rest detachably at a retaining lug 33 formed on the stationary chamber 1. In their retained position, the jaws 31 and 32 bear against both sides of a retaining lug plate 34.

The snap lever 4 is pivotally mounted in the lower section of the stationary chamber 1 by way of the bolt 5. In the assembled state, a snap lug 35 protrudes from the stationary chamber 1 and supports the toggle joint of the switch lock inside the overload protection switch in the switched-on position, and therefore supports the overload protection switch in the switched-on position. The snap lever 4 is controlled by the action of a snap lever spring 36, which supports itself with one end on a spigot 37 of the snap lever 4, and with the other end against another portion of the housing (not illustrated). The snap lever spring 36 ensures that during switching-on, the support surface 21 of the snap lever 4 bears against the snap lever support 20 at the main slide 2.

Figure 3:
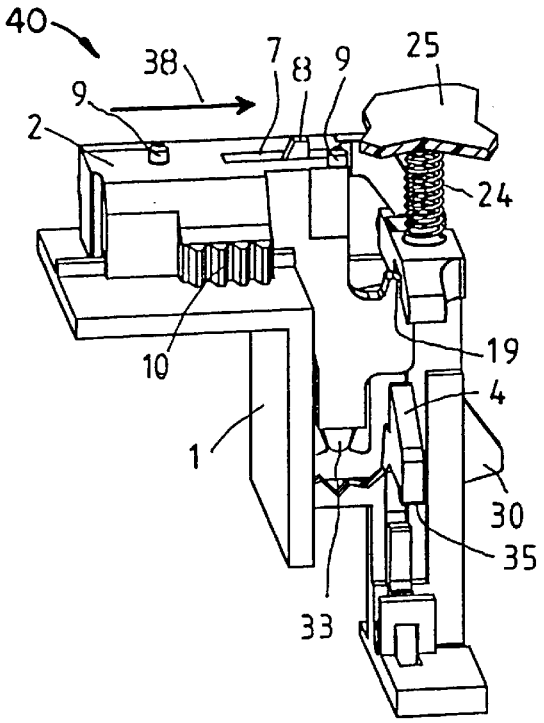
FIG. 3 is a perspective view of the latching mechanism of FIG. 1 at the start of a switching-on motion.

Referring now to FIGS. 3–and 16–17, the operation of the latching mechanism is now described in greater detail.

Figure 4:
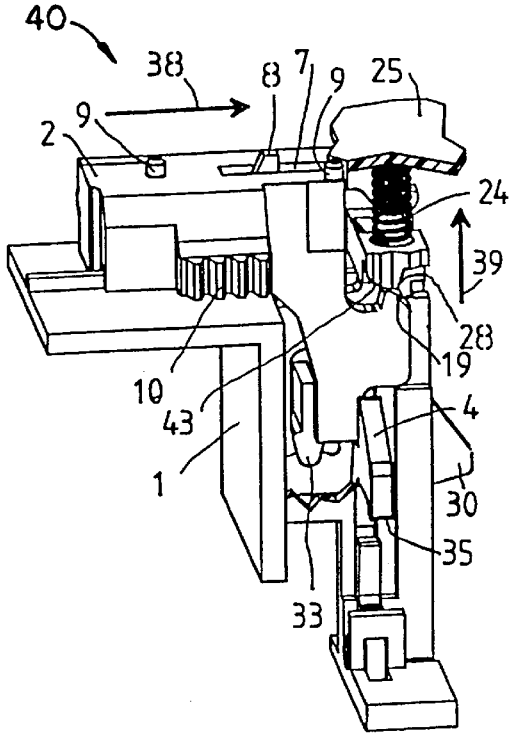
FIG. 4 is a perspective view of the latching mechanism of FIG. 1 in an intermediate position during the switching-on motion.
Figure 5:
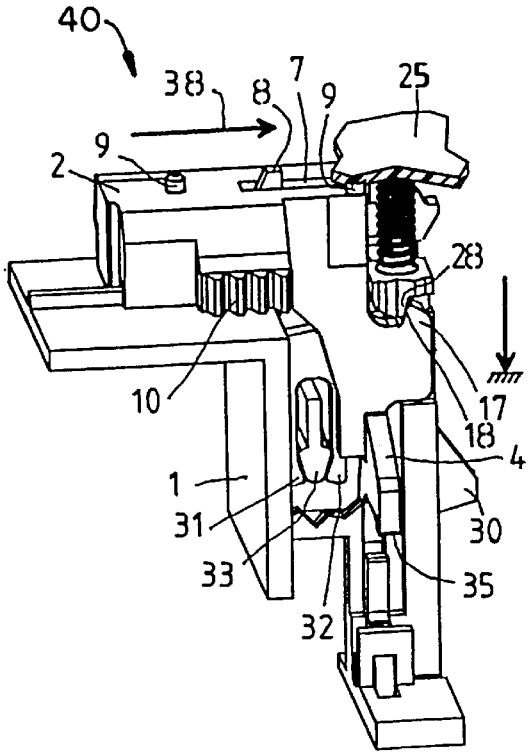
FIG. 5 is a perspective view of the latching mechanism of FIG. 1 in a switched-on position.
Figure 16:
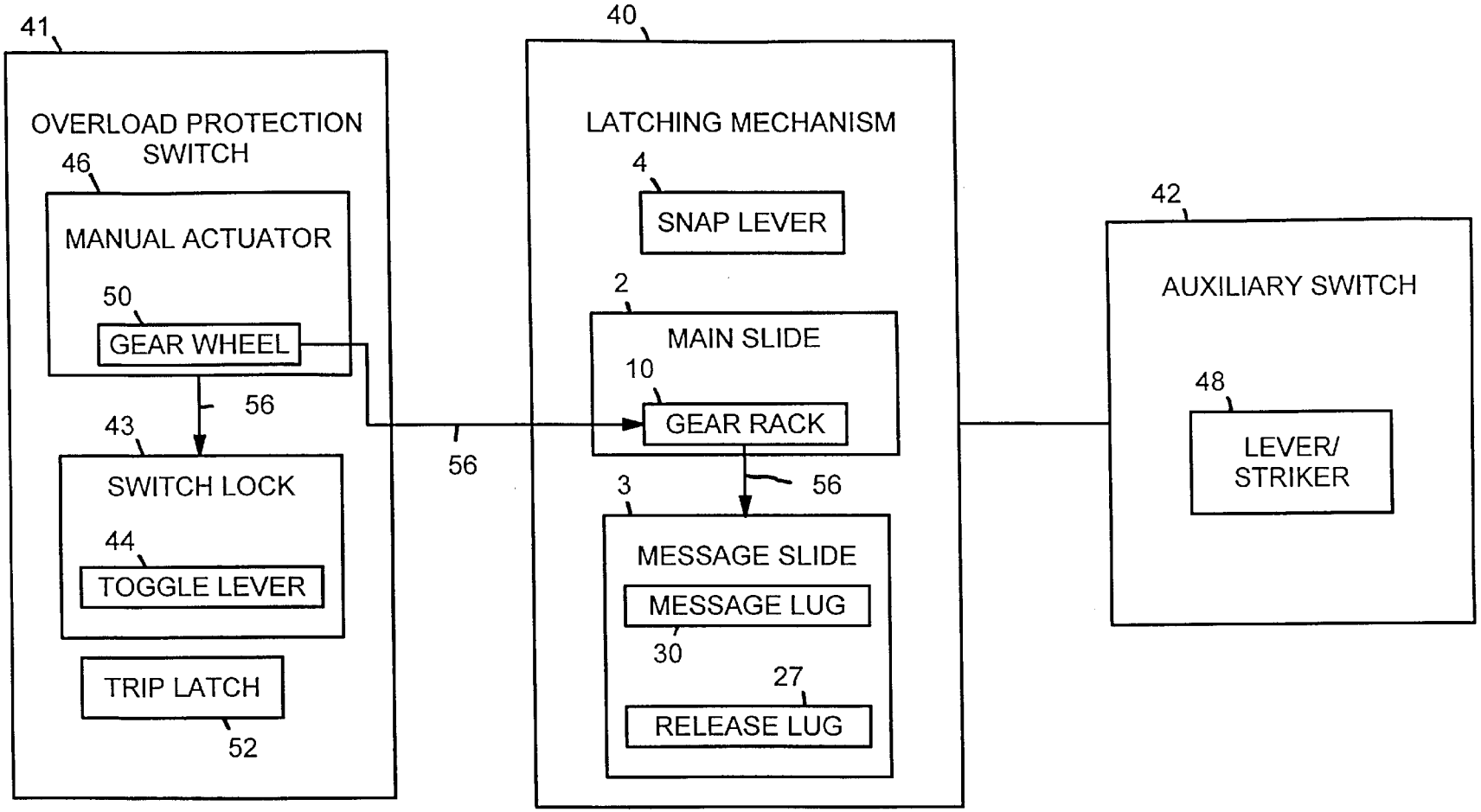
FIG. 16 is a schematic view of the operation of the latching mechanism of FIG. 1 during a switching on motion.

FIG. 3 illustrates the latching mechanism at the start of a switching-on motion from a switched-off position, and FIG. 16 illustrates schematically the switching on motion. The main slide 2, by way of the gear rack 10, is pushed by a switching on impulse 56 from the manual actuator (see FIG. 16) in the direction of arrow 38 (see FIG. 3). During this action, the main spring 12 of the main slide 2 is tensioned. During this motion, the message slide 3 is pushed up in the direction of arrow 39 by the flat switch-on bevel 19, also as a result of the switching on impulse 56, tensioning the message slide spring 24, as illustrated in FIG. 4. After passing the highest point of the switch-on bevel 19, the message slide 3 is returned into its rest position by the message spring 24, as is evident from FIG. 5. At this time, the main slide 2 with the gear rack 10 also reaches its final position. As a result of the steep switch-off bevel surface 28 of the message slide 3, the main slide 2 remains in this position during the release of the manual actuator. The latching mechanism is locked to its switch-on position, as illustrated in FIG. 5.

Figure 6:
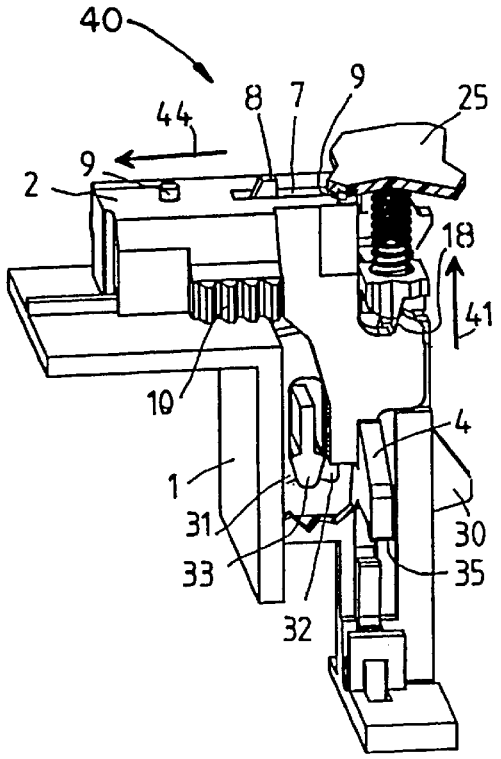
FIG. 6 is a perspective view of the latching mechanism of FIG. 1 at the start of a switching-off motion.
Figure 7:
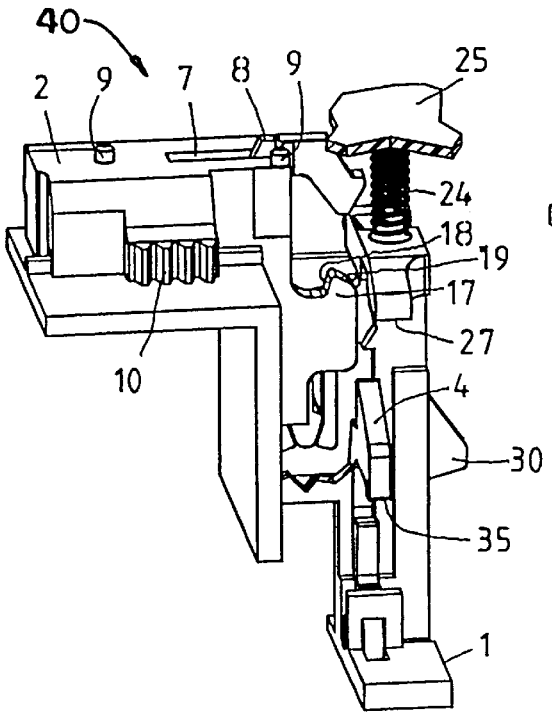
FIG. 7 is a perspective view of the latching mechanism of FIG. 1 in a switched-off position.

During a switching-off motion, the manual actuator is actuated into the opposite direction. The main slide 2 is moved in the direction of arrow 44, as illustrated in FIG. 6. At the start of the switching-off motion, an increased force must be applied to the manual actuator, since the steep switch-off bevel 18 of the main slide 2 must push the message slide 3 from its locked position in the direction of arrow 41. After passing through the highest point of the switch-off bevel 18, the entire latching mechanism, also during the release of the manual actuator, returns to the switched-off position, which is its starting position. The force for resetting after releasing the locking mechanism is generated by the main spring 12. The switched-off position is illustrated in FIG. 7.

Figure 8:
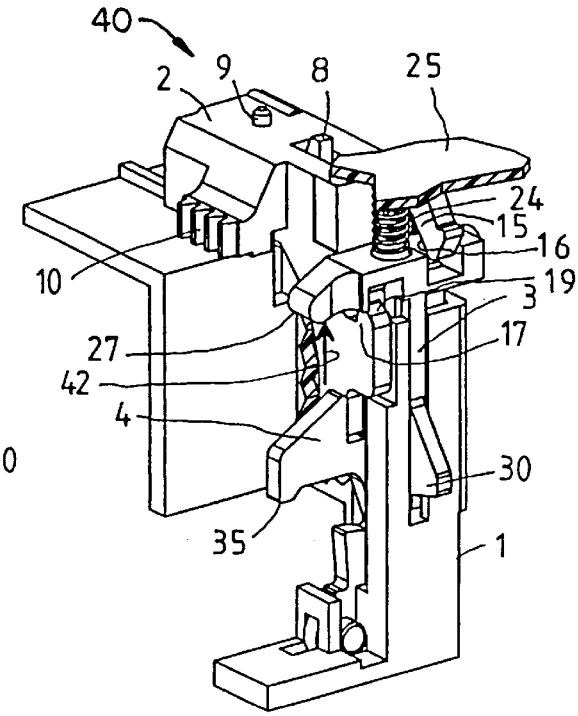
FIG. 8 is a perspective view of the latching mechanism of FIG. 1 at the start of a tripping motion from the switched-on position into a tripped position.
Figure 9:
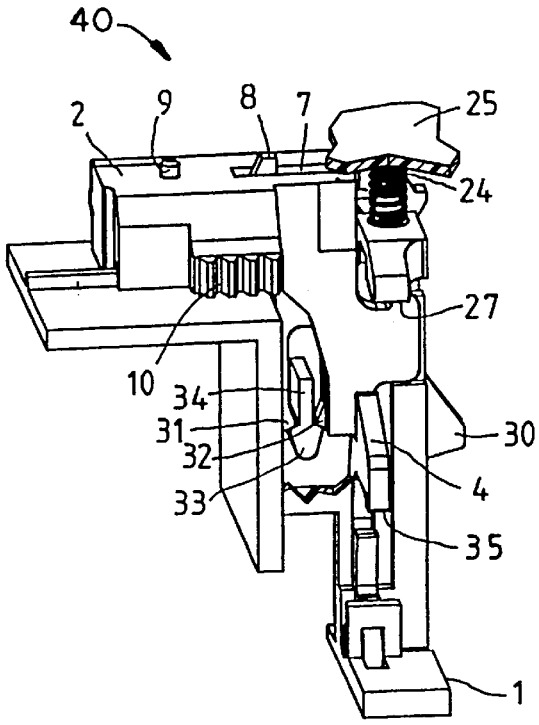
FIG. 9 is a perspective view of the latching mechanism of FIG. 1 in an intermediate position during the tripping motion from the switched-on position into the tripped position.
Figure 10:
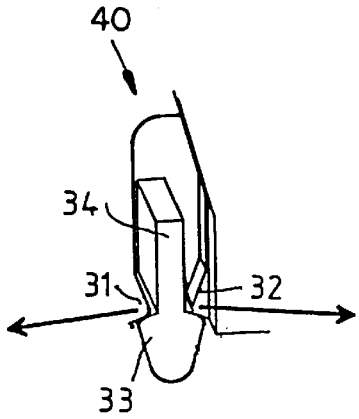
FIG. 10 is a perspective view of a snap lock of the latching mechanism of FIG. 1 in a latched position.
Figure 11:
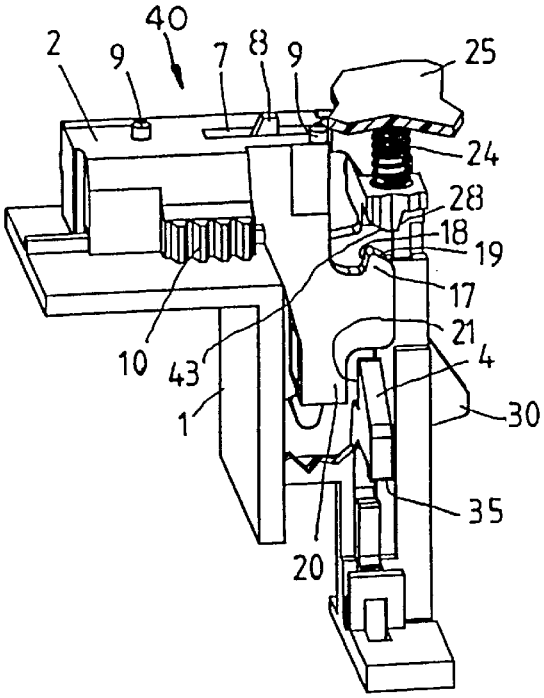
FIG. 11 is a perspective view of the latching mechanism of FIG. 1 in a tripped position.
Figure 17:
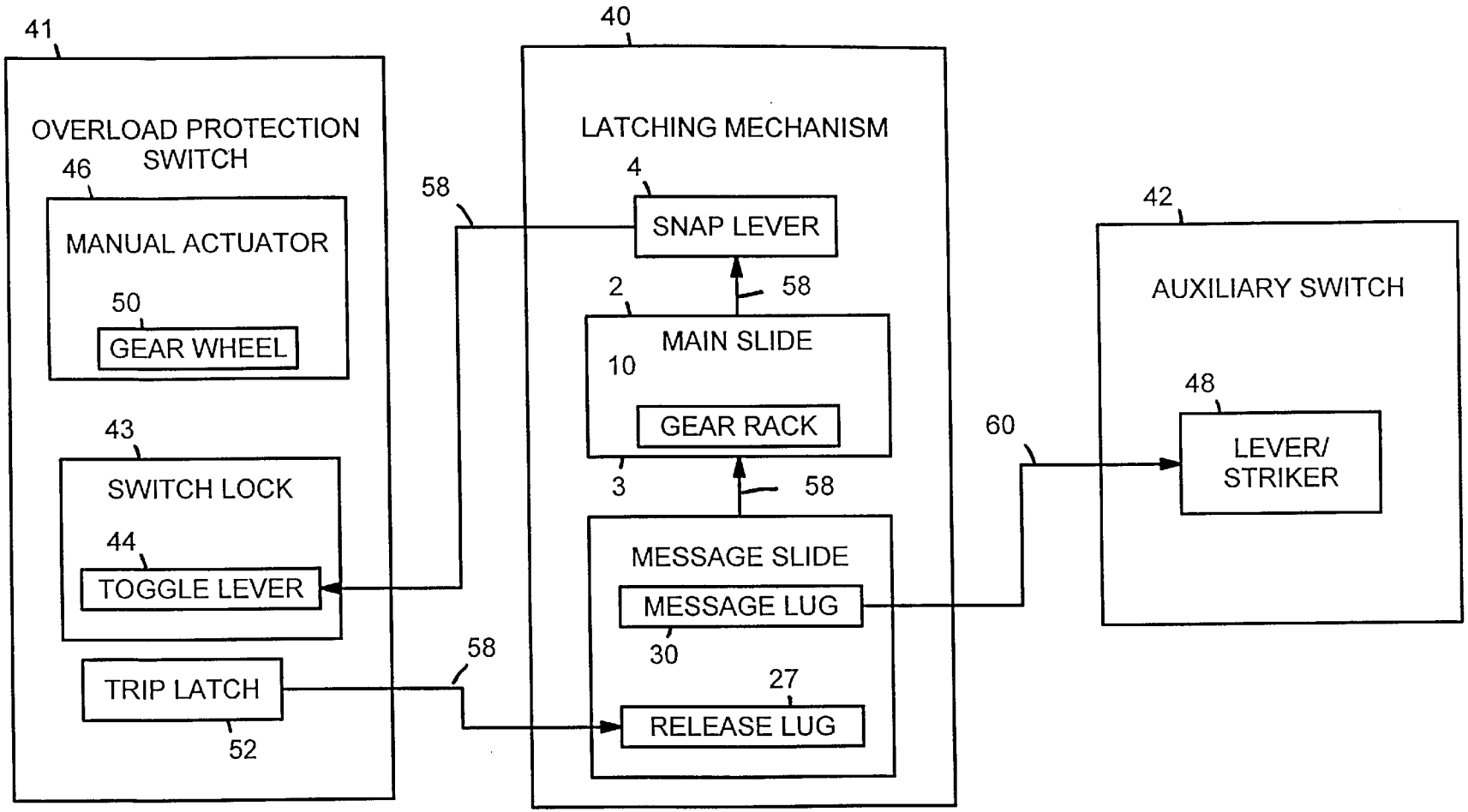
FIG. 17 is a schematic view of the operation of the latching mechanism of FIG. 1 during a tripping motion.

During a thermal or magnetic tripping of the overload protection switch, the trip latch 52 of the overload protection switch 41 transmits a tripping motion impulse 58 in the direction of arrow 42 onto the release lug 27 of the message slide 3, as illustrated in FIGS. 8 and 17. As a result, the message slide 3 moves rapidly in the direction of arrow 42. After a certain motion, the flat bevels of the retaining lug 33 push apart the jaws 31 and 32 of the message slide 3, as illustrated in FIGS. 9 and 10. After passing the highest point of the striking bevels of the retaining lug 33, the jaws 31 and 32 return to their rest position and lie on both sides of the retaining lug plate 34. The message slide 3 thereafter remains locked in the tripped position as illustrated in FIG. 11.

Figure 12:
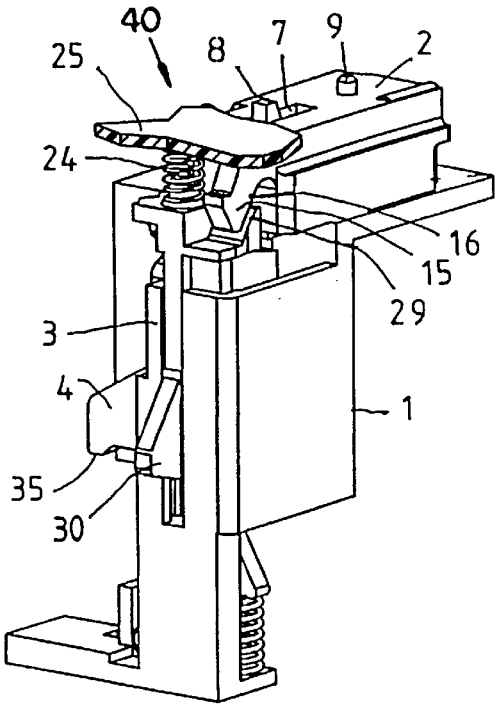
FIG. 12 is a perspective view of the latching mechanism of FIG. 1 in the tripped position, viewed from a different angle.

The latching of the main slide 2 is released at the start of the motion of the message slide 3. The main slide 2 thereafter moves on its own to the switch-off direction, due to the main spring 12. During this motion, the snap lever support 20 that lies on the main slide 2 removes itself from the support surface 21 of the snap lever 4. In this position, the snap lever 4 no longer supports the joint of the toggle lever, allowing the toggle lever to buckle, whereupon the switch-off follows. Since the message slide 3 has reached the locked released position in the mean time, the main slide 2 cannot return to the switched-off position. This is achieved through the striking bevel 16 and through the striking counter-bevel 29, because both abut against each other, as illustrated in FIG. 12. The main slide 2, and thereby, also the manual actuator 46 that is positively connected with it, remain in the released position. The unique positioning of the message slide 3 in the released position is used for the actuation of auxiliary switching elements to give a collective released message 60 via the message lug 30.

Figure 13:
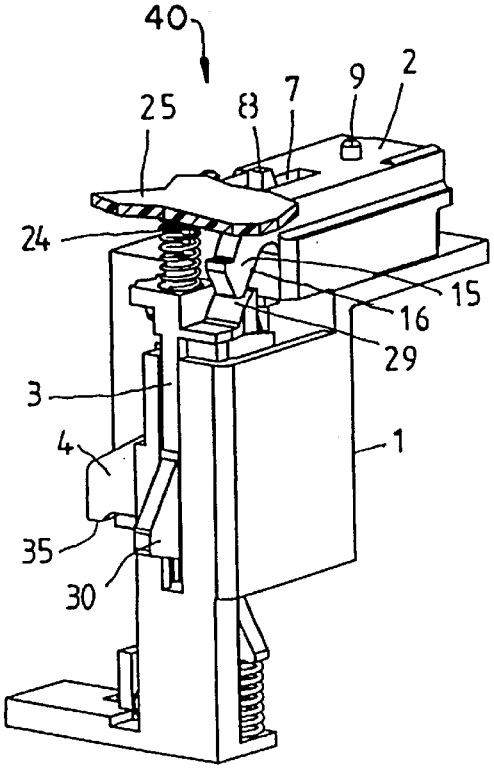
FIG. 13 is a perspective view of the latching mechanism of FIG. 1 in an intermediate position during a reset motion from the tripped position into a switched-off position with the assistance of a manual actuator.
Figure 14:
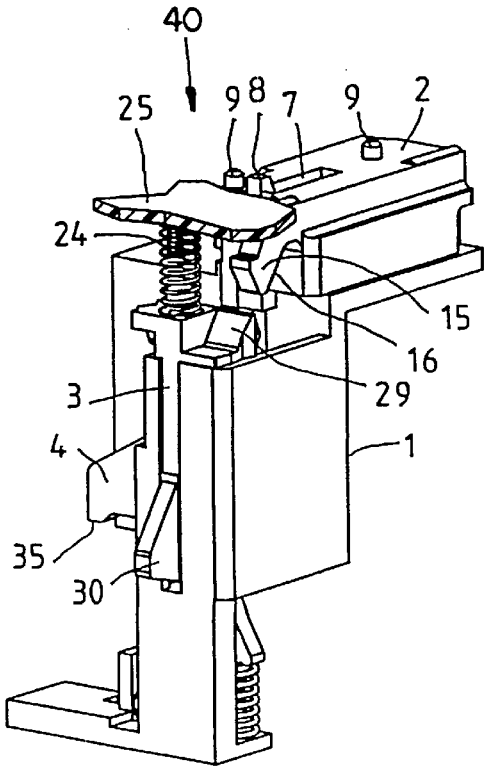
FIG. 14 is a perspective view of the latching mechanism of FIG. 1 in the switched-off position.

During the resetting of the latching mechanism from the released position, the manual actuator 46 must be actuated in the OFF-direction, as illustrated in FIG. 13. At the start of this motion, an increased force must be applied manually in order to actuate the release mechanism. This happens through the striking bevel 16 on main slide 2, as illustrated in FIG. 13. The striking bevel 16 pushes the message slide 3 across the striking counter bevel 29, down and out of its lock caused via the action of both jaws 31 and 32 and the retaining lug 33. After releasing the lock of the message slide 3, it returns to its rest position through the action of the message slide spring 24. The latching mechanism 40 and miscellaneous auxiliary switching elements automatically return into their resting positions, as previously described for the switch-off procedure. In this way, the latching mechanism 40 achieves the switched-off position, as illustrated in FIG. 14.

Many other changes and modifications may be made to the present invention without departing from the spirit thereof. The scope of these and other changes will become apparent from the appended claims.

We claim:

1. A latching mechanism for latching an overload protection switch, the latching mechanism comprising:

A. a stationary chamber, the stationary chamber including
   1. a first guide, the first guide extending in a first direction, and
   2. a second guide, the second guide extending in a second direction which is perpendicular to the first direction;

B. a main slide, the main slide being movable along the first guide, the main slide being mechanically coupled to a manual actuator, the main slide including 1. a first switch-off bevel,
2. a first switch-on bevel,
3. a striking bevel,
4. a snap lever support, and
5. a main spring, the main spring spring-loading the main slide;

C. a message slide, the message slide being movable along the second guide, the message slide including
1. a second switch-off bevel,
2. a second switch-on bevel,
3. a striking counter bevel, and
4. a message slide spring, the message slide spring spring-loading the message slide;

D. a snap lever, the snap lever being pivotally mounted to the stationary chamber, the snap lever including a snap lever spring which spring loads the snap lever;

wherein the latching mechanism has a switched-off position, a switched-on position, and a tripped position which respectively correspond to a switched-off position, a switched-on position, and a tripped position of the overload protection switch, and wherein the main slide, message slide, and the snap lever each have a switched-off position, a switched-on position, and a tripped position which respectively correspond to the switched-off position, the switched-on position, and the tripped position of the latching mechanism;

wherein, during a switching-on motion from the switched-off position to the switched-on position of the latching mechanism, the main slide moves the message slide to the switched-on position by way of the first and second switch-on bevels;

wherein, in the switched-on position of the latching mechanism, the main slide and message slide are locked in the switched-on position by the first and second switch-off bevels, and the snap lever support supports the snap lever in the switched-on position, the snap lever in turn supporting the overload protection switch in a switched-on position of the overload protection switch;

wherein, during a tripping motion from the switched-on position to the tripped position of the latching mechanism, a tripping motion impulse is applied to the message slide and moves the message slide along the second guide to the tripped position, the movement of the message slide unlocking the message slide and the main slide from the switched-on position, the unlocking of the main slide causing the main slide spring to move the main slide along the first guide to the tripped position, and the movement of the main slide causing the snap lever support to release the snap lever;

wherein, in the tripped position of the latching mechanism, the striking counter bevel retains the main slide in the tripped position; and wherein, during a resetting motion from the tripped position to the switched-off position, the striking counter bevel cooperates with the striking bevel to move the message slide to the switched-off position.

2. A latching mechanism according to claim 1, wherein the main slide has a box-shaped cavity formed therein, and wherein the main spring is housed in the box-shaped cavity, the main spring supporting itself with one end on an inside wall of the main slide, and with another end on a fixed inset which protrudes into the box-shaped cavity of the main slide.

3. A latching mechanism according to claim 2, wherein the main slide has a gear rack disposed thereon, the gear rack being mechanically coupled to the manual actuator.

4. A latching mechanism according to claim 3, wherein the message slide includes a release lug which protrudes from the stationary chamber and which engages a trip latch of the overload protection switch.

5. A latching mechanism according to claim 4, wherein the message slide includes a message lug which protrudes from the stationary chamber and which transmits a tripped-message to an auxiliary switch.

6. A latching mechanism according to claim 5, wherein the message slide includes a snap lock formed of two resilient members which, in the switched-on position of the latching mechanism, detachably rest at a retaining lug formed on the stationary chamber.

7. A latching mechanism according to claim 1, wherein the latching mechanism further includes a housing, and wherein the message slide spring supports itself with one end on the housing of the latching mechanism, and with the other end on a portion of the message slide.

8. A latching mechanism for latching an overload protection switch, the latching mechanism comprising:

A. a stationary chamber, the stationary chamber including
1. a first guide, the first guide extending in a first direction, and
2. a second guide, the second guide extending in a second direction which is perpendicular to the first direction;

B. a main slide, the main slide being movable along the first guide, the main slide being mechanically coupled to a manual actuator, and the main slide including a main spring which spring-loads the main slide; and C. a message slide, the message slide being movable along the second guide, the message slide including a message slide spring which spring-loads the message slide.

9. A latching mechanism according to claim 8, wherein the latching mechanism further includes a housing, and wherein the message slide spring supports itself with one end on the housing of the latching mechanism, and with the other end on a portion of the message slide.

10. A latching mechanism according to claim 9, wherein the main slide has a box-shaped cavity formed therein, and wherein the main spring is housed in the box-shaped cavity, the main spring supporting itself with one end on an inside wall of the main slide, and with the other end on a fixed portion of the stationary chamber.

11. A latching mechanism according to claim 9 wherein, when the overload protection switch trips, the message slide receives a tripping motion impulse from the overload protection switch, the tripping motion impulse causing the message slide to move to a message slide tripped position, the movement of the message slide unlocking the main slide from a switched-on position, the unlocking of the main slide from the switched-on position permitting the main spring to move the main slide to a main slide tripped position.

12. A latching mechanism according to claim 11, wherein the main slide includes a first switch-off bevel, wherein the message slide includes a second switch-off bevel, and wherein the first and second switch-off bevels cooperate to lock the main slide in the switched-on position when the main slide is in the switched-on position.

13. A latching mechanism according to claim 8, wherein the main slide has a gear rack disposed thereon, the gear rack being mechanically coupled to the manual actuator.

14. A latching mechanism according to claim 13, wherein the message slide includes a release lug which protrudes from the stationary chamber and which engages a portion of the overload protection switch.

15. A latching mechanism according to claim 14, wherein the message slide transmits a tripped-message to an auxiliary switch.

16. A latching mechanism according to claim 15, wherein the message slide includes a snap lock formed of two resilient members which, in the switched-on position of the latching mechanism, detachably rest at a retaining lug formed on the stationary chamber.

17. A latching mechanism for latching an overload protection switch, the latching mechanism comprising:

A. a stationary chamber, the stationary chamber including
1. a first guide, the first guide extending in a first direction, and
2. a second guide, the second guide extending in a second direction which is perpendicular to the first direction;

B. a main slide, the main slide being movable along the first guide, the main slide being mechanically coupled to a manual actuator, and the main slide including a main spring which spring-loads the main slide;

C. a message slide, the message slide being movable along the second guide, the message slide including a message slide spring which spring-loads the message slide;

D. a snap lever, the snap lever being pivotally mounted to the stationary chamber, the snap lever including a snap lever spring which spring-loads the snap lever;

wherein the latching mechanism has a switched-off position, a switched-on position, and a tripped position which respectively correspond to a switched-off position, a switched-on position, and a tripped position of the overload protection switch, and wherein the main slide, message slide, and the snap lever each have a switched-off position, a switched-on position, and a tripped position which respectively correspond to the switched-off position, the switched-on position, and the tripped position of the latching mechanism;

wherein, in the switched-on position of the latching mechanism, the main slide and the message slide are locked in the switched-on position;

wherein, during a tripping motion from the switched-on position to the tripped position of the latching mechanism, a tripping motion impulse is applied to the message slide and moves the message slide along the second guide to the tripped position, the movement of the message slide unlocking the message slide and the main slide from the switched-on position, the unlocking of the main slide causing the main slide spring to move the main slide along the first guide to the tripped position;

wherein, in the tripped position of the latching mechanism, the main slide and the message slide are locked in the tripped position;

wherein, during a resetting motion from the tripped position to the switched-off position, a force is applied to the main slide by way of the manual actuator and moves the main slide to move to the switched-off position, the movement of the main slide unlocking the main slide and the message slide from the tripped position and moving the message slide to the switched-off position.

18. A latching mechanism according to claim 17, wherein the latching mechanism further includes a housing, and wherein the message slide spring supports itself with one end on the housing of the latching mechanism, and with the other end on a portion of the message slide.

19. A latching mechanism according to claim 18, wherein the main slide has a box-shaped cavity formed therein, and wherein the main spring is housed in the box-shaped cavity, the main spring supporting itself with one end on an inside wall of the main slide, and with the other end on a fixed portion of the stationary chamber.

20. A latching mechanism according to claim 19, wherein the message slide transmits a tripped-message to an auxiliary switch.

* * * * *